US008177521B2

(12) United States Patent
Chen et al.

(10) Patent No.: US 8,177,521 B2
(45) Date of Patent: May 15, 2012

(54) SYSTEM AND METHOD FOR MONITORING AND CONTROLLING OIL RETURN TO COMPRESSOR

(75) Inventors: Chun-Han Chen, Hsinchu (TW); Chung-Ping Chiang, Hsinchu (TW); Ching-Fu Chen, Hsinchu (TW); Yun-Jui Chung, Hsinchu (TW); Yen-Chieh Wang, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 444 days.

(21) Appl. No.: 12/409,781

(22) Filed: Mar. 24, 2009

(65) Prior Publication Data

US 2010/0196170 A1 Aug. 5, 2010

(30) Foreign Application Priority Data

Feb. 2, 2009 (TW) ..... 98103171 A

(51) Int. Cl.
*F04B 39/02* (2006.01)
*F04B 39/06* (2006.01)

(52) U.S. Cl. ..... 417/228; 417/13; 417/32; 417/36

(58) Field of Classification Search ..... 417/13, 417/32, 36, 53, 228, 18, 26, 44.1, 44.2
See application file for complete search history.

(56) References Cited

U.S. PATENT DOCUMENTS

| | | | | |
|---|---|---|---|---|
| 5,000,009 | A * | 3/1991 | Clanin | 62/115 |
| 6,171,069 | B1 * | 1/2001 | Levitin et al. | 417/187 |
| 6,266,946 | B1 | 7/2001 | Aylward | |
| 6,266,964 | B1 * | 7/2001 | Meyer et al. | 62/115 |
| 6,834,514 | B2 | 12/2004 | Takeuchi et al. | |
| 6,993,920 | B2 * | 2/2006 | Lifson et al. | 62/173 |

* cited by examiner

*Primary Examiner* — Joseph L Williams
*Assistant Examiner* — Nathaniel Lee
(74) *Attorney, Agent, or Firm* — Rabin & Berdo, P.C.

(57) ABSTRACT

A system and method for monitoring and controlling oil return to a compressor, characterized by monitoring and controlling oil level, oil temperature, and compressor outlet pressure, so as to determine whether the oil level is lower than a predetermined level threshold, whether the temperature in the lubricating oil box is lower than a predetermined temperature threshold, and whether the compressor outlet pressure exceeds a predetermined pressure threshold, so as to control the flow of lubricating oil returned to the oil box by controlling the valve opening of the oil return valve according to a non-segmentation principle or a segmentation principle, ensure sufficient lubricating oil in the oil box, and enhance efficiency of the system.

31 Claims, 4 Drawing Sheets

| | Oil Level (cm) | Valve Opening (%) |
|---|---|---|
| Segment 1 | $H1 \leqq L$ | 0 |
| Segment 2 | $N2 \leqq L < H1$ | 15 |
| Segment 3 | $N1 \leqq L < N2$ | 30 |
| Segment 4 | $L1 \leqq L < N1$ | 50 |
| Segment 5 | $L < L1$ | 100 |

FIG.3B

SYSTEM AND METHOD FOR MONITORING AND CONTROLLING OIL RETURN TO COMPRESSOR

BACKGROUND OF THE INVENTION

1. Field of the Invention

The present invention relates to a technology for monitoring and controlling oil return to a compressor, and more specifically, to a method and a system for monitoring and controlling quantity of a lubricating oil returned to an oil box of the compressor by controlling valve opening of an oil return valve at an oil return inlet of the oil box.

2. Description of the Related Art

Chillers are familiar refrigerating equipment in a central air conditioning system. Ice water produced by chillers efficiently lowers indoor temperature by heat exchange and via pipelines. In recent years, chillers are getting popular. A compressor is central to a chiller as far as the operation thereof is concerned. The compressor is a special air pump. The compressor in operation has to be continuously lubricated with lubricating oil in order to minimize friction. During a compression process of the compressor, a copious discharge of coolant (i.e., refrigerant) usually accompanies a loss of a trace of lubricating oil (known as "escaping oil"), which is inevitable. More badly, when discharged from the compressor, lubricating oil does not return to the oil box of the compressor in the end. As a result, the compressor tends to run out of lubricating oil. A shortage of lubricating oil causes friction to the detriment of bearings and then the compressor itself, thus damaging the chiller. Hence, the control of the lubricating oil return to the oil box is of vital importance to a central air conditioning system.

To return the otherwise discharged lubricating oil to the oil box, manufacturers usually put an oil return valve at the oil return inlet of the oil box, leave the oil return valve open to the full, that is, an opening of 100%, and drive the lubricating oil back to the oil box through the valve under a high pressure provided at a high-pressure outlet of the compressor at the cost of extra electrical power. However, the level of lubricating oil is not monitored and the number of the oil return is not controlled in the way as above. Even though the oil return is monitored, it still not ensures the lubricating oil return to oil box fully. Thereby the lubricating oil is decreasing with time. The operation of the compressor is hardly smooth because of low oil level. In addition, the system wastes a lot of electric energy because the oil return valve stays open. Hence, the system efficiency is going down.

In order to avoid low oil level and improve the system. U.S. Pat. No. 6,834,514 (FIGS. 6 and 7) and U.S. Pat. No. 6,993,920 (FIGS. 8 and 9) have disclosed an oil level sensor disposed in the oil box to detect the oil level and control the valve opening (0% or 100%, that is, by ON-OFF control) of an oil return valve provided at an oil return inlet of the oil box. The air conditioning system shuts down when the oil level is lower than an alert threshold. But the prior art still has drawbacks, for example, valve opening is switched between 0% and 100%, which is a rather great increment or decrement of valve opening. The compressor wastes a lot of electric energy and deteriorates the efficiency when the opening is 100%.

In conclusion, there is an urgent need for a method for overcoming the drawbacks of the prior art, so as to ensure a sufficiently high oil level, reduce high-pressure power loss, and render the system safe, reliable and efficient.

BRIEF SUMMARY OF THE INVENTION

Therefore, an objective of the present invention is to provide a more convenient way to use a system for monitoring and controlling oil return to a compressor so as to ensure the oil in the oil box is enough to protect the compressor and the bearings.

In another embodiment, the present invention provides a method and system for monitoring and controlling oil return to the compressor so as to reduce the high-pressure power loss and enhance the efficiency of the system.

In another embodiment, the present invention provides a system and method for monitoring and controlling oil return to the compressor in a way that the system and method are safe to operate.

To achieve the above objectives, the present invention provides a method for monitoring and controlling oil return to the compressor which are applied in a system for monitoring and controlling the quantity of the returned oil in the oil box by controlling valve opening of an oil return valve provided at an oil return inlet of an oil box. The system comprises: an oil return valve provided at the oil return inlet; a pressure sensor provided at an outlet of the compressor, and an oil level sensor and a temperature sensor provided in the oil box. The method for monitoring and controlling oil return to the compressor comprises: providing a lowest oil level of oil in the oil box; providing a pressure required for oil return; providing an initial oil return flag; providing the oil level of oil return corresponding to the initial oil return flag; providing a maximum temperature value and providing a minimum temperature value.

To detect the temperature value of the oil box and determine the initial oil level value, the compressor is shut down when the lowest oil level exceeds the initial oil level value, otherwise analyze the pressure of the returned oil, oil level in the oil box, and temperature value and to detect the temperature value of the oil in the oil box and determining the temperature value, the oil box is to be warming up when the temperature value is not equal to a minimum temperature value, otherwise the temperature value is to be between the minimum value and the maximum value; and detect the pressure value of the returned oil and determine the pressure value, and maintain full opening of the oil return valve when the pressure exceeds a pressure value necessary for oil return, otherwise maintain full opening of the oil return valve. Hence, valve opening of the oil return valve is controlled by a non-segmentation principle or a segmentation principle.

Proportional-integral-derivative (PID) controller algorithm applies to the non-segmentation principle. The control flow comprises: retrieving the initial oil return flag of oil and making a true value of the oil level value to a first oil level value and a false value of oil level value to a second oil level value; calculating the difference between the measured oil level value and the oil level of the returned oil and obtaining the range of valve opening of the oil return valve and resetting the oil return flag to the true value when the valve opening is increasing, or resetting the oil return flag to the false value when the valve opening is not increasing; and controlling the valve opening by converting the range of valve opening to an electric signal instruction. The range of valve opening is defined and divided into standard segments according to the segmentation principle. The segments match different valve openings of the oil return valve, respectively. The segments and the valve openings are identified and determined according to the measured oil level values. Then, the segments confirmed are converted into electric signals to control the valve opening.

The method further comprises determining whether the oil level exceeds the lowest oil level value, analyzing the pressure of the returned oil and the temperature of the oil box so as to perform the periodical analysis when the oil level exceeds the lowest oil level value, otherwise, the compressor is shut down.

The temperature sensor detects the temperature value, the pressure sensor detects the oil pressure value and the heater warms up the temperature of the oil box.

The steps of warming up comprise: setting the oil temperature to the minimum temperature and to determine the pressure of oil return, controlling valve opening of the oil return valve and reducing quantity of the cooling water when the pressure of oil is lower than the pressure required for oil return, otherwise maintain full opening of the oil return valve. The electric signal instruction is a voltage signal, from 0 to 10 Volts, or a current signal, from 4 to 20 mA.

On the other hands, the oil return flag is one of the first and second values, the first value is the false value and the second value is the true value. Alternatively, the first value is the true value, and the second value is the false value. Alternatively, the first oil level value is the high oil level value, and the second oil level value is the low oil level value, and the initial oil return flag is the true value. The five segments are determined to control the valve opening of the oil return valve.

The present invention provides a system for monitoring and controlling oil return to a compressor, so as to monitor quantity of the returned oil in the oil box by controlling the valve opening of the oil return valve. The system for monitoring and controlling oil return to the compressor comprises: a pressure sensor provided at an outlet of the compressor and detects the pressure of the returned oil; an oil return valve provided at an oil return inlet and coupled to the pressure sensor by controlling the valve opening of the oil return valve according to a segmentation principle or a non-segmentation principle; an oil level sensor provided in the oil box to detect the temperature of oil in the oil box and detect the pressure of the oil returned to the oil box, oil level in the oil box and temperature periodically and convert the measurement result to the oil return valve, so as to monitor and control quantity of the returned oil in the oil box by controlling the valve opening of the oil return valve according to the segmentation principle or the non-segmentation principle.

The measurement result is converted into an electric signal instruction according to the segmentation principle or the non-segmentation principle. The electric signal instruction is a voltage signal ranging from 0 to 10 volt or is a current signal ranging from 4 to 20 mA.

The system for monitoring and controlling oil return to a compressor further comprises the jet pump provided at an oil return inlet of the oil box and connected to the oil return valve. It can be a power source that sends feedback to the outlet of the compressor and the heater provided in the oil box.

Regarding the system for monitoring and controlling oil return to a compressor, PID controller algorithm applies to the non-segmentation principle.

If the segmentation principle is adopted, the oil level in the oil box is divided into a plurality of segments, and the segments correspond to different valve openings, respectively, so as to control the valve opening of the oil return valve by the oil level. Preferably, the oil level is divided into five segments.

Compared with the prior art, in the embodiment of the present invention, the oil level is determined by monitoring and controlling the temperature value and oil level value of the lubricating oil in the oil box, as well as the pressure value at the high-pressure outlet of the compressor, so as to maintain the temperature of the lubricating oil at between the predetermined minimum and maximum temperature. At the same time, the pressure value at the high-pressure outlet of the compressor is monitored and controlled, by controlling the valve opening of the oil return valve according to the segmentation principle or the non-segmentation principle.

As disclosed in the present invention, consideration is given to three parameters, namely the temperature value and oil level value of the lubricating oil, and the pressure value at the high-pressure outlet of the compressor. As disclosed in the present invention, valve opening of the oil return valve is controlled in a continuous manner (without segmentation) or in a segmented manner (with segmentation), so as to prevent a waste of power and promote the efficiency of the system. Also, the system of the present invention is safe, because the present invention discloses the lowest oil level value and thereby prevents the oil box from running out of lubricating oil to the detriment of the operation of the compressor.

BRIEF DESCRIPTION OF THE DRAWINGS

The present invention can be more fully understood by reading the subsequent detailed description and examples with references made to the accompanying drawings, wherein:

FIG. 3B is a table showing parameters used in controlling the valve opening of the high-pressure gas oil return valve according to a segmentation principle.

DETAILED DESCRIPTION OF THE INVENTION

Figure 1:
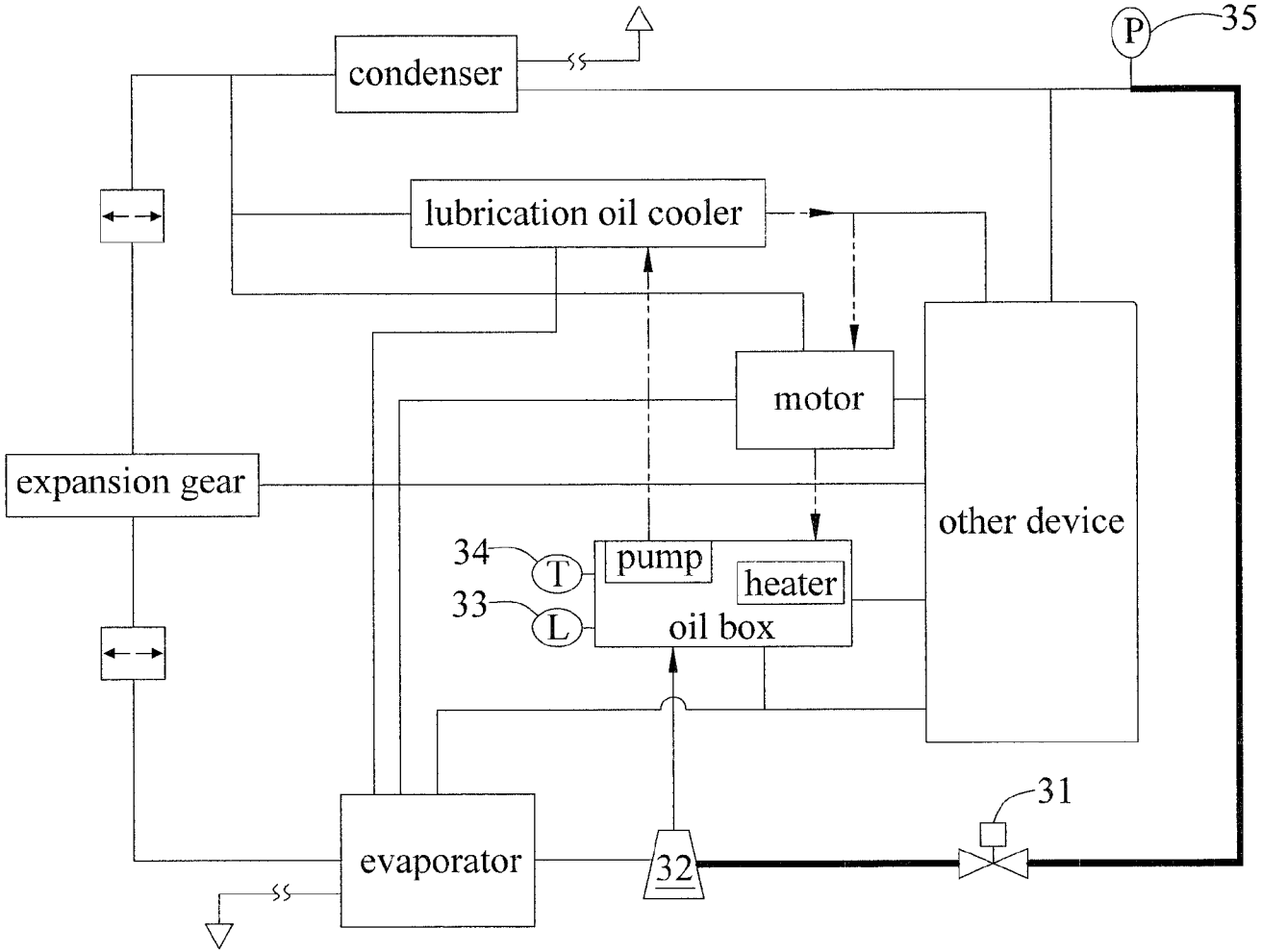
FIG. 1 is a schematic diagram of a system for monitoring and controlling oil return to a compressor for use with a centrifugal chiller.

Please refer to FIG. 1. FIG. 1 is a schematic diagram of a system for monitoring and controlling oil return to a compressor for use with a centrifugal chiller. As illustrated in the drawing, the system for monitoring and controlling of oil return to a compressor comprises a jet pump 32, a pressure sensor 35, an oil level sensor 33, a temperature sensor 34, and a high-pressure gas oil return valve 31. In the embodiment of the present invention, the jet pump 32 gives feedback to the outlet pressure of the compressor as a power supply. The pressure sensor 35 is directly installed at the outlet of the compressor. The oil level sensor 33 and the temperature sensor 24 are installed in the oil box. Three parameters, namely oil level in the oil box, temperature of the oil box, and pressure at the high-pressure outlet of the compressor, are measured simultaneously. Signals are sampled periodically so as to determine whether the quantity of the returned oil is appropriate. The result of the determination is sent to the high-pressure gas oil return valve as a basis for the instructions that control the valve opening. In an embodiment of the present invention, the quantity of the lubricating oil returned to the oil box is efficiently monitored and controlled by controlling the valve opening of the high-pressure gas oil return valve 31.

At the very beginning, allowable minimum temperature value T1 and allowable maximum temperature value T2 of lubricating oil stored in the oil box, allowable lowest oil level value Lmin of the lubricating oil in the oil box, pressure value Pset required for oil return, an oil return flag (as shown in FIG. 5A), and the oil level d of the returned oil corresponding to the oil return flag (as shown in FIG. 5A) are predetermined. In an embodiment of the present invention, in view of the characteristics of coolant, the maximum temperature value T2 is set to 55° C., the minimum temperature value T1 to 40° C., the lowest oil level value Lmin to 6 cm, and the pressure value Pset required for oil return to 7 kg*f/cm$^2$ (R-134A).

Next, the step of "detecting the oil level value of the lubricating oil in the oil box in real time" is performed, and then the detected oil level value is outputted. The oil level value is detected by the oil level sensor 33 in the oil box. Then, the oil level value detected and outputted is received. If the current oil level of the lubricating oil is less than the lowest oil level value Lmin, the compressor is shut down, and the monitoring and controlling process ends.

Figure 2:
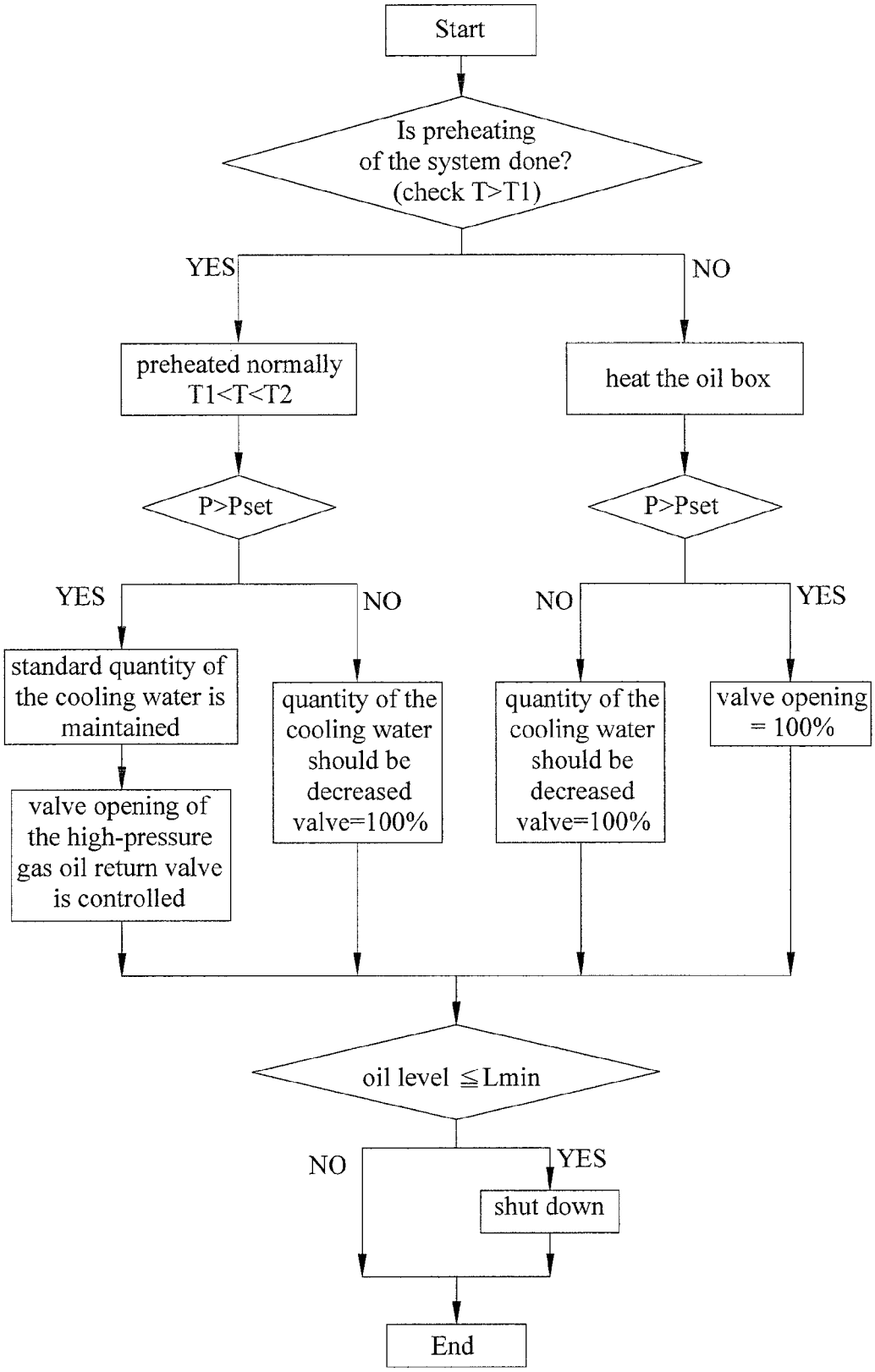
FIG. 2 is a flow chart of the oil level, temperature and pressure of an oil box according to an embodiment of the present invention.

Upon determination that the current oil level of the lubricating oil exceeds the lowest oil level value Lmin, the three parameters (oil level in the oil box, temperature of the oil box, and pressure at the high-pressure outlet) are ready for analysis as shown in the flow chart in FIG. 2.

Referring to FIG. 2, upon determination that preheating of the system is done, the step of "detecting the current temperature T of the lubricating oil in the oil box" is performed, and then the measured value is outputted. The temperature value T is detected by the temperature sensor 34 in the oil box. Afterward, the temperature value T detected and outputted is received. Next, the temperature value T is determined to see whether it is equal to the minimum temperature value T1 or not.

If the temperature value T is not equal to the minimum temperature value T1 (false), the step of warming up is performed. The lubricating oil in the oil box is heated until the temperature value T is equal to the minimum temperature T1. Then, the pressure value P at the high pressure source is checked and determined to see whether the pressure value P is sufficient to effectuate oil return (P>Pset). If the pressure value P is higher than the pressure value Pset, the high-pressure gas oil return valve 31 will have to be fully opened (100%), and this step will end, otherwise, quantity of the cooling water should be decreased (by 5%), and (100%) full opening of the high-pressure gas oil return valve 31 is controlled and maintained. The lubricating oil in the oil box is preheated by a heater (as shown in FIG. 3) installed in the compressor.

If the temperature value T is equal to the minimum temperature value T1 (true), the lubricating oil is normally preheated according to the temperature value T, and the temperature value T is set to between the minimum temperature value T1 and the maximum temperature value T2 (T1<T<T2); meanwhile, the step of "detecting the current pressure value P at the high-pressure outlet of the compressor in real time" is performed, and then the detected pressure value P is outputted. The pressure value P is detected by the pressure sensor 35 provided at the high-pressure outlet of the compressor.

Next, the pressure value P is compared with the predetermined pressure value Pset so as to determine whether the pressure value P is higher than the predetermined pressure value Pset. If the pressure value P is higher than the predetermined pressure value Pset, the standard quantity of the cooling water is maintained, and the valve opening of the high-pressure gas oil return valve 31 is controlled (as shown in FIG. 5A); upon a negative determination, the quantity of the cooling water is decreased, and the valve opening of the high-pressure oil return 31 is set to full (100%).

Next, the oil level value is compared with the lowest oil level value Lmin so as to determine whether the oil level value is less than the lowest oil level value Lmin. If the oil level value is less than the lowest oil level value Lmin (true), the system is shut down. If no (false), end this process.

Figure 3A:
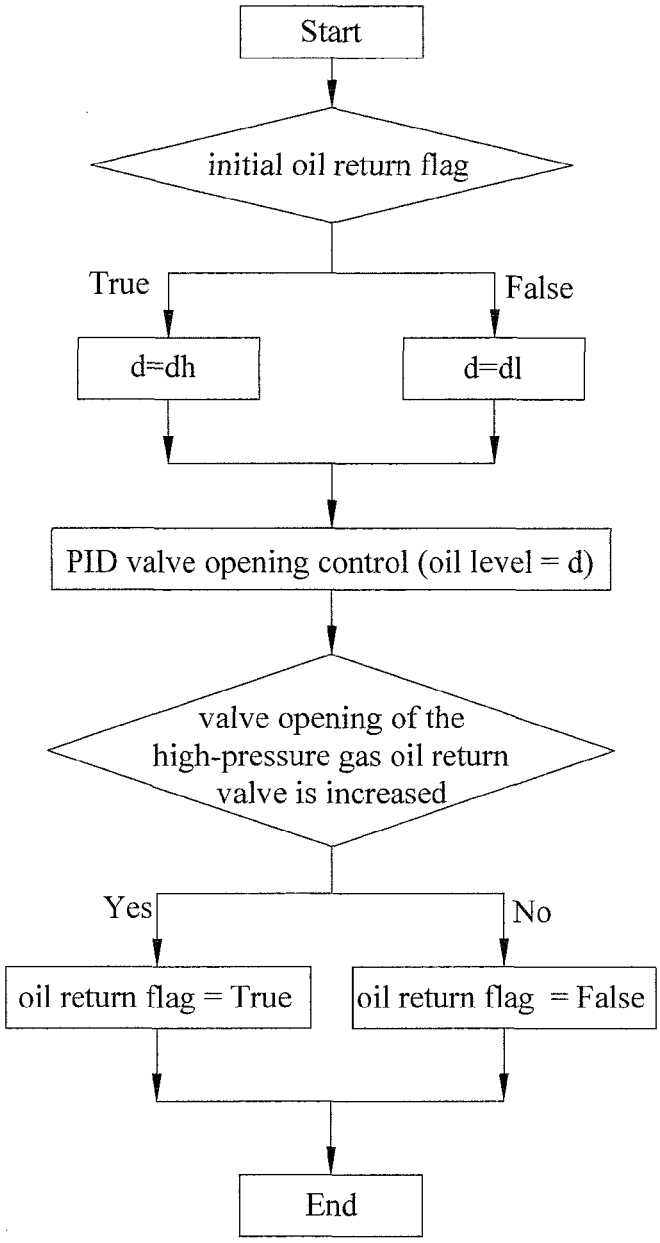
FIG. 3A is a flow chart of controlling the valve opening of the high-pressure gas oil return valve according to a non-segmentation principle, wherein FIG. 3A' is a schematic diagram of the oil level in FIG. 3A.
Figure 3A:
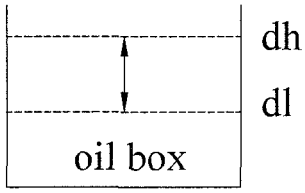

Referring to FIG. 3A and FIG. 3A', a process for controlling valve opening of the high-pressure gas oil return valve 31 is shown. Options, namely a segmentation principle and a non-segmentation principle, are available to the step of controlling the valve opening of the high-pressure gas oil return valve 31. As shown in FIG. 3A, proportional-integral-derivative (PID) controller algorithm applies to the non-segmentation principle to retrieve the oil return flag and determine the oil return flag. If the oil return flag is true, the oil level value d is set to a first oil level value dh. If the oil return flag is false, the oil level value d is set to a second oil level value dl. The oil return flag is one of a first value and a second value. The first value and the second value are logical negation of each other. The oil return flag represents one of the first oil level value dh and the second oil level value dl, that is, an oil level of the lubricating oil in the oil box, so as to give initial definition of the oil return flag. In the embodiment of the present invention, the first value is set to true, and the second value is set to false. Alternatively, the first value is set to false and the second value to true. Similarly, the first oil level value dh (corresponding to the first value) is a high oil level value, and the second oil level value dl (corresponding to the second value) is a low oil level value. Therefore, the user sets the oil return flag to true or false initially according to the real-time oil level value.

Next, the range of valve opening of the high-pressure gas oil return valve 31 is calculated according to the current oil level, oil level value d (the goal value) and the predetermined PID controller algorithm. Then the calculated range of valve opening is converted into electrical signal instructions for controlling the valve opening of the high-pressure gas oil return valve 31.

The oil level value d is a standard value for PID controller algorithm. The difference between the current oil level value and the standard value for PID controller algorithm is calculated. The adjustable range of valve opening of the high-pressure gas oil return valve 31 relative to the current valve opening is calculated by PID controller algorithm. The PID controller algorithm is well known by persons ordinarily skilled in the art, and thus it is not described in detail herein for brevity.

The electric signal instruction is a voltage signal (from 0 to 10 V) or is a current signal (from 4 to 20 mA). Conversion of the values (range of valve opening) into an electric signal instruction is well known by those of ordinary skill in the art, and thus it is not described in detail herein for brevity.

Next, the tendency of the range of valve opening to vary is determined according to the calculated range of valve opening. If the range of valve opening increases, then reset the oil return flag to true; otherwise, the oil return flag is reset to false. At this point, the step of controlling the valve opening of the high-pressure gas oil return valve 31 ends.

As shown in FIG. 3A, the adjusting opening signal is produced by PID controller algorithm (i.e., according to the non-segmentation principle) with opening of high pressure gas oil return valve 31 that is adjusted by an electric signal instruction. Compared with the prior art (being left open all the time or using on-off oil return control), the non-segmentation principle adopted in the present invention is more reasonable. The valve opening of the high-pressure oil return valve 31 is accurately controlled by PID-based optimization of real-time oil level value of the lubricating oil, wherein the valve opening does not stay at 100% or switch between 0% and 100%, thereby enhancing efficiency of the system.

To provide insight into the non-segmentation principle disclosed in the present invention, exemplification is as follows: the first value is set to true, the second value to false, the first oil level value (high oil level value) dh to 25 cm, the second oil level value (low oil level value) dl to 15 cm, and the oil return flag is initially defined as the first value (true). Specifically speaking, the oil return flag is retrieved, and the oil return flag is checked and determined whether the oil return flag is true, when the current temperature T of the lubricating oil in the oil box is between the predetermined minimum temperature T1 and the maximum temperature T2 and the pressure value P at the high-pressure outlet of the compressor exceeds the predetermined pressure value Pset. Since the oil return flag is initially defined as true, the oil level value d is set to high oil level value (25 cm). Next, the high oil level value is treated as the standard value for PID controller algorithm, and the difference between the current oil level value and the standard value for PID controller algorithm is calculated according to the current oil level value detected and outputted. The PID controller algorithm calculates the adjustable range of valve opening of the high-pressure gas oil return valve 31 relative to the current valve opening thereof, and the calculated range of valve opening is converted into an electric signal instruction for (electrically) controlling the valve opening of the high-pressure gas oil return valve 31.

Next, the oil return flag is reset according to the calculated tendency of the range of valve opening to vary. The oil return flag is reset to true when the range of valve opening tends to increase. Next, go back to the step of "detecting the current oil level value of the lubricating oil in the oil box in real time" prior to analysis of the three parameters, and reset the oil level value d required for the next PID controller algorithm according to the flag value of the oil return flag. The oil return flag is reset to false when the range of valve opening tends to decrease. Next, go back to the step of "detecting the current oil level value of the lubricating oil in the oil box in real time" prior to analysis of the three parameters, and reset the oil level value d required for the next PID controller algorithm according to the flag value of the oil return flag.

Please refer to FIG. 3B. FIG. 3B is a table showing parameters used in controlling the valve opening of the high-pressure gas oil return valve 31 according to a segmentation principle. As shown in the drawing, like components applied to the segmentation principle and the non-segmentation principle are denoted alike, and detailed description of the components are omitted herein for brevity.

According to the segmentation principle, the current temperature value T of the lubricating oil in the oil box is set to between the predetermined minimum temperature T1 and maximum temperature T2. If the pressure value P at the high-pressure outlet of the compressor exceeds the predetermined pressure value Pset, the oil level values of the lubricating oil are divided into segments, and the oil level values of the lubricating oil correspond to the valve openings of the high-pressure gas oil return 31, respectively. The predetermined range of the oil level values are searched so as to determine the predetermined range of the oil level values within which the oil level values fall. The valve opening is determined in accordance with the relationship of the oil level values determined and the valve openings.

As shown in FIG. 3B, under the segmentation principle, the quantity of the returned oil is controlled according to oil level, and thus five segments are defined, namely Segment 1 (H1≦oil level L), Segment 2 (N2≦oil level L<H1), Segment 3 (N1≦oil level L<N2), Segment 4 (L1≦L<N1) and Segment 5 (L<L1). The control mechanism for the high-pressure oil return valve 31 is regulated by detecting the segments and their respective outputs.

Next, the measured valve opening is converted into the electric signal instruction (0~10V or 4-20 mA) for controlling valve opening (0-100%). The valve opening of the high-pressure gas oil return valve 31 provided at the oil return inlet of the oil box is electrically controlled in a precise manner by the segmentation principle, so as to prevent the oil box from running out of the returned oil to the detriment of the compressor.

For example, the segments is H1=25 cm, N2=23 cm, N1=20 cm and L1=15 cm. The oil level L is searched and determined to be falling within Segment 3 when oil level L=22 cm is detected. Hence, the current valve opening is 30%, and the current valve opening is converted into the electric signal instruction to control the valve opening. In so doing, drawbacks of the prior art are overcome.

In conclusion, in the embodiment of the present invention, the oil level and the lowest oil level value are determined based on the oil level, temperature and pressure in the oil box. If the oil level is less than the lowest oil level value, the compressor is shut down, otherwise, the temperature of the lubricating oil in the oil box is monitored; if the temperature is less than the predetermined minimum temperature, then the lubricating oil is to be warmed up until the temperature value equals the minimum temperature value, and then full valve opening is maintained, otherwise, the temperature of the lubricating oil is set to between the minimum and maximum temperatures. At the same time, the pressure value at the high-pressure outlet of the compressor is monitored. If the pressure value exceeds the predetermined pressure value, the valve opening of the oil return valve of the oil box is controlled according to a segmentation principle or a non-segmentation principle. The lubricating oil is returned to the oil box. Hence, the bearings are sufficiently lubricated with the lubricating oil so as for the bearings to operate smoothly.

Moreover, in the embodiment of the present invention, the valve opening of the high-pressure oil return valve is controlled by the continuous control (without segments) or segmented control (with segments) so as to enhance efficiency of the system. The lowest oil level is defined, so as to avoid a shortage of the returned oil.

While the present invention has been described by way of examples and in terms of the preferred embodiments, it is to be understood that the present invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A method for monitoring and controlling oil return to a compressor, applicable to a monitoring and controlling system for monitoring and controlling a quantity of returned oil in an oil box by controlling a valve opening of an oil return inlet of the oil box, and wherein the system comprises an oil return valve provided at the oil return inlet, a pressure sensor provided at an outlet of the compressor, and an oil level sensor and a temperature sensor provided in the oil box, the method comprising the steps of:

setting a lowest oil level of oil in the oil box, a pressure value required for oil return, an initial oil return flag, an oil level of the returned oil corresponding to the initial oil return flag, a maximum temperature value, and a minimum temperature value;

detecting an initial oil level value of the oil in the oil box, determining whether the initial oil level value detected exceeds the lowest oil level, and shutting down the compressor upon a negative determination;

detecting a temperature value of the oil in the oil box, determining whether the temperature value detected exceeds the minimum temperature value, warming up the oil box upon a negative determination, and heating the oil box to allow the temperature value of the oil in the oil box to fall between the minimum temperature value and the maximum temperature value upon an affirmative determination;

detecting a pressure value of the returned oil, determining whether the pressure value detected exceeds the pressure value required for oil return, maintaining full valve opening of the oil return valve upon a negative determination, and controlling the valve opening of the oil return valve upon an affirmative determination;

controlling the valve opening of the oil return valve according to a non-segmentation principle calculated with a proportional-integral-derivative (PID) controller algorithm, the controlling comprising: retrieving the initial oil return flag and setting a true value of the oil level value to a first oil level value and a false value of oil level value to a second oil level value; calculating a difference between a measured oil level value and the oil level value of the returned oil, so as to obtain an adjustable range of the valve opening of the oil return valve; determining whether the adjustable range of the valve opening of the oil return valve tends to increase, resetting the oil return flag to the true value upon an affirmative determination, and resetting the oil return flag to the false value upon a negative determination; and converting a range of the valve opening obtained into an electric signal instruction for controlling the valve opening; and determining whether the oil level value is less than or equal to the lowest oil level value, shutting down the compressor upon an affirmative determination, and analyzing the pressure value of the returned oil and the temperature value of the oil box for performing periodical analysis upon a negative determination.

2. The method as claimed in claim 1, wherein the oil return flag is one of the first and second values, the first value being the false value, and the second value being the true value.

3. The method as claimed in claim 1, wherein the oil return flag is one of the first and second values, the first value being the true value, and the second value being the false value.

4. The method as claimed in claim 1, wherein the first oil level value is a high oil level value, the second oil level value is a low oil level value, and the initial oil return flag is the true value.

5. The method as claimed in claim 1, wherein the oil level sensor detects the oil level value.

6. The method as claimed in claim 1, wherein the temperature sensor detects the temperature value.

7. The method as claimed in claim 1, wherein the pressure sensor detects the pressure value of the returned oil.

8. The method as claimed in claim 1, wherein the heating of the oil box is performed by a heater.

9. The method as claimed in claim 1, wherein the step of warming up comprises:

heating the oil box until the temperature value of the oil equals the minimum temperature value; and determining whether the pressure value of the returned oil exceeds the pressure value required for oil return, maintaining the full valve opening of the oil return valve upon an affirmative determination, and decreasing the quantity of the cooling water and maintaining the full valve opening of the oil return valve upon a negative determination.

10. The method as claimed in claim 1, wherein the electric signal instruction is a voltage signal from 0 to 10 V or a current signal from 4 to 20 mA.

11. A method for monitoring and controlling oil return to a compressor, applicable to a system for monitoring and controlling oil return to a compressor such that a quantity of oil returned to an oil box is monitored and controlled by controlling a valve opening of an oil return inlet of the oil box, wherein the system comprises an oil return valve provided at the oil return inlet, a pressure sensor provided at an outlet of the compressor, and an oil level sensor and a temperature sensor provided in the oil box, the method comprising the steps of:

setting a lowest oil level of oil in the oil box, a pressure value required for oil return, an initial oil return flag, an oil level of the returned oil corresponding to the initial oil return flag, a maximum temperature value, and a minimum temperature value;

detecting an initial oil level value of the oil in the oil box, determining whether the initial oil level value detected exceeds the lowest oil level, and shutting down the compressor upon a negative determination;

detecting a temperature value of the oil in the oil box, determining whether the temperature value detected exceeds the minimum temperature value, warming up the oil box upon a negative determination, and heating the oil box to allow the temperature value of the oil in the oil box to fall between the minimum temperature value and the maximum temperature value upon an affirmative determination;

detecting a pressure value of the returned oil, determining whether the pressure value detected exceeds the pressure value required for oil return, maintaining full valve opening of the oil return valve upon a negative determination, and controlling the valve opening of the oil return valve upon an affirmative determination;

controlling the valve opening of the oil return valve according to a segmentation principle, wherein the segmentation principle entails dividing the range of oil level values into standard segments corresponding to valve openings of the oil return valve, respectively, so as to control a quantity of the returned oil, determining the segments within which the detected oil level values fall so as to determine the valve opening, and converting the obtained segments into an electric signal instruction for controlling the valve opening; and determining whether the oil level value is less than or equal to the lowest oil level value, shutting down the compressor upon an affirmative determination, and analyzing the pressure value of the returned oil and the temperature value of the oil box for performing periodical analysis upon a negative determination.

12. The method as claimed in claim 11, wherein the oil level sensor detects the oil level value.

13. The method as claimed in claim 11, wherein the temperature sensor detects the temperature value.

14. The method as claimed in claim 11, wherein the pressure sensor detects the oil pressure value.

15. The method as claimed in claim 11, wherein the heating of the oil box is performed by a heater.

16. The method as claimed in claim 11, wherein the electric signal instruction is a voltage signal from 0 to 10 V or a current signal from 4 to 20 mA.

17. The method as claimed in claim 11, wherein the step of warming up comprises:

heating the oil box until the temperature value of the oil equals the minimum temperature value; and determining whether the pressure value of the returned oil exceeds the pressure value required for oil return, maintaining the full valve opening of the oil return valve upon an affirmative determination, and decreasing quantity of cooling water and maintaining the full valve opening of the oil return valve upon a negative determination.

18. The method as claimed in claim 11, wherein the segmentation principle entails defining five segments so as to control the valve opening of the oil return valve.

19. A system for monitoring and controlling oil return to a compressor, wherein the system controls a quantity of returned oil in an oil box of a compressor, the system comprising:

a pressure sensor provided at an outlet of the compressor to detect a pressure value of oil returned to the compressor;

an oil return valve provided at an oil return inlet of the oil box and coupled to the pressure sensor, wherein valve opening of the oil return valve is controlled according to a non-segmentation principle;

an oil level sensor provided in the oil box to detect an oil level value of oil in the oil box; and a temperature sensor provided in the oil box to detect a temperature value of oil in the oil box;

wherein the pressure value of the returned oil at the outlet of the compressor and the temperature value and the oil level value of the oil in the oil box are measured periodically, and the measurement result is sent to the oil return valve, so as to monitor and control the quantity of the returned oil in the oil box by controlling the valve opening of the oil return valve according to the non-segmentation principle.

20. The system as claimed in claim 19, wherein a proportional-integral-derivative (PID) controller algorithm applies to the non-segmentation principle.

21. The system as claimed in claim 19, wherein the non-segmentation principle entails converting the measurement result into an electric signal instruction so as to control the valve opening of the oil return valve.

22. The system as claimed in claim 21, wherein the electric signal instruction is a voltage signal from 0 to 10 V or a current signal from 4 to 20 mA.

23. The system as claimed in claim 19, further comprising a jet pump provided at the oil return inlet of the oil box, coupled to the oil return valve, and configured to provide feedback to the outlet of the compressor as a power supply.

24. The system as claimed in claim 19, further comprising a heater provided in the oil box.

25. A system for monitoring and controlling oil return to a compressor, wherein the system controls quantity of returned oil in an oil box of the compressor, the system comprising:

a pressure sensor provided at an outlet of the compressor to detect a pressure value of the returned oil in the compressor;

an oil return valve provided at an oil return inlet of the oil box and coupled to the pressure sensor, wherein valve opening of the oil return valve is controlled according to a segmentation principle;

an oil level sensor provided in the oil box to detect an oil level value of oil in the oil box; and a temperature sensor provided in the oil box to detect a temperature value of oil in the oil box ;

wherein the pressure value of the returned oil at the outlet of the compressor and the temperature value and the oil level value of the oil in the oil box are measured periodically and the measurement result is sent to the oil return valve, so as to monitor and control quantity of the returned oil in the oil box by controlling the valve opening of the oil return valve according to the segmentation principle.

26. The system as claimed in claim 25, wherein the segmentation principle entails dividing the oil level values into a plurality of segments corresponding to valve openings of the oil return valve, respectively, so as to control the valve opening of the oil return valve according to the oil level values.

27. The system as claimed in claim 26, wherein the oil level values are divided into five segments.

28. The system as claimed in claim 25, wherein the segmentation principle entails converting the measurement result into an electric signal instruction for controlling the valve opening of the oil return valve.

29. The system as claimed in claim 28, wherein the electric signal instruction is a voltage signal from 0 to 10 V or a current signal from 4 to 20 mA.

30. The system as claimed in claim 25, further comprising a jet pump provided at an oil return inlet of the oil box, coupled to the oil return valve, and configured to provide feedback to the outlet of the compressor as a power supply.

31. The system as claimed in claim 25, further comprising a heater provided in the oil box.

* * * * *